US005996167A

United States Patent [19]

Close

[11] Patent Number: 5,996,167

[45] Date of Patent: Dec. 7, 1999

[54] SURFACE TREATING ARTICLES AND METHOD OF MAKING SAME

[75] Inventor: Thomas E. Close, Troy Twp., Wis.

[73] Assignee: 3M Innovative Properties Company, Saint Paul, Minn.

[21] Appl. No.: 08/559,333

[22] Filed: Nov. 16, 1995

[51] Int. Cl.[6] ..... B44D 5/00; B24B 9/02

[52] U.S. Cl. ..... 15/230.12; 15/230.14; 15/230.16; 451/466; 451/468

[58] Field of Search ..... 15/230, 230.12, 15/230.14, 230.16; 451/424, 534, 544, 541, 466, 526, 468

[56] References Cited

U.S. PATENT DOCUMENTS

| | | |
|---|---|---|
| 2,843,469 | 7/1958 | Miller et al. . |
| 2,951,004 | 8/1960 | Martin et al. . |
| 2,958,593 | 11/1960 | Hoover et al. . |
| 2,991,165 | 7/1961 | Meyer et al. . |
| 3,018,262 | 1/1962 | Schroeder . |
| 3,102,010 | 8/1963 | Lang et al. . |

(List continued on next page.)

FOREIGN PATENT DOCUMENTS

| | | |
|---|---|---|
| 1 112 878 | 11/1981 | Canada . |
| 0 290 095 | 11/1988 | European Pat. Off. . |
| 0 513 798 A2 | 11/1992 | European Pat. Off. . |
| 0 560 018 A1 | 9/1993 | European Pat. Off. . |
| 0 635 334 A2 | 1/1995 | European Pat. Off. . |
| 2 187 745 | 9/1987 | United Kingdom . |

OTHER PUBLICATIONS

Database WPI Section Ch, Week 9206, Derwent Publications Ltd., London GB; Class ALP, AN 92–046940; XP002025950 & SU 1 648 739 A (Tekhnolog, Cotton PR.), May 15, 1991.

Principles of Polymer Systems, 2nd Ed. McGraw–Hill, Jan. 1982, pp. 362–380.

Structural Core Splice Adhesive AF–3024, Aerospace Technical Data, Issue No. 1, Jun. 1986, 3M Product Information.

3M Wheels, pp. 1–15 3M Canada Product Information, dated Jan. 1990, 61–5000–8732–7.

Scotch–Brite™ High Resolution Printed Circuit Cleaning Brushes and Flap Brushes, 3M Canada Product Information, dated Jan. 1990, 61–5000–7470–5.

*Primary Examiner*—James F. Hook

*Attorney, Agent, or Firm*—Daniel R. Pastirik; Scott A. Bardell

[57] ABSTRACT

Surface treating articles and methods for the manufacture of such articles are provided. The articles of the invention comprise a rotatable core; a plurality of surface treating segments, the segments having first ends adjacent the core and second ends opposite the first ends; and a cured, expanded adhesive composition bonding the surface treating segment to the core, the adhesive composition comprising (a) an organic epoxide compound having an epoxide functionality of at least 1, (b) an epoxide hardener, (c) a film-forming material, and (d) a foaming agent; wherein the expanded adhesive provides a substantially continuous bond area extending from the core into and around the first end of the segments. The method for the manufacture of the articles comprises applying the foregoing adhesive to the core, applying the surface treating segments to the core by positioning the first ends of the segments adjacent the core and in contact with the adhesive; expanding the adhesive into the first ends of the surface treating segments; and hardening the adhesive to form the surface treating article.

16 Claims, 2 Drawing Sheets

U.S. PATENT DOCUMENTS

| | | | |
|---|---|---|---|
| 3,406,488 | 10/1968 | Rykken . | |
| 3,445,436 | 5/1969 | Lake et al. . | |
| 3,597,887 | 8/1971 | Hall, Jr. . | |
| 3,645,049 | 2/1972 | Freerks et al. . | |
| 3,699,727 | 10/1972 | McDonald . | |
| 4,145,369 | 3/1979 | Hira et al. . | |
| 4,258,509 | 3/1981 | Wray et al. . | |
| 4,275,529 | 6/1981 | Teetzel et al. . | |
| 4,448,590 | 5/1984 | Wray et al. . | |
| 4,455,788 | 6/1984 | Freerks . | |
| 4,563,839 | 1/1986 | Huppert . | |
| 4,653,135 | 3/1987 | Clark | 15/230.16 |
| 4,872,292 | 10/1989 | Block | 451/534 |
| 4,933,373 | 6/1990 | Moren . | |
| 5,019,605 | 5/1991 | Jannic . | |
| 5,274,006 | 12/1993 | Kagoshima et al. . | |
| 5,397,414 | 3/1995 | Garcia et al. | 15/230.12 |
| 5,427,595 | 6/1995 | Pihl et al. . | |
| 5,453,453 | 9/1995 | Lamon et al. . | |
| 5,460,883 | 10/1995 | Barber, Jr. et al. . | |
| 5,554,068 | 9/1996 | Carr et al. | 451/466 |
| 5,722,881 | 3/1998 | Emerson | 451/466 |

SURFACE TREATING ARTICLES AND METHOD OF MAKING SAME

The present invention relates to surface treating articles and to a method for the manufacture of such articles.

BACKGROUND OF THE INVENTION

Surface treating articles such as flap brushes, cleaning brushes, bristle brushes and convolute wheels are known. Exemplary of these surface treating articles are those available from the Minnesota Mining and Manufacturing Company of St. Paul, Minn. under the trade designation "Scotch-Brite". Flap brushes include a central core with a plurality of compressed radially extending strips or flaps of abrasive-containing nonwoven material. An edge of each flap is attached to the core while the opposing free edges of the compressed flaps form the outer working surface of the brush. Surface conditioning operations with these articles are accomplished by rotating the core while the working surface of the article is maintained in contact with a workpiece. Flap brushes may be used, for example, in the surface preparation and conditioning of metals, woods, plastics and other materials to prepare the surfaces for painting, plating, or the like as well as to impart a desired finish to the surface of a workpiece. The construction of other surface treating articles such as cleaning brushes, bristle brushes, convolute wheels and the like is similar to the aforementioned flap brushes in that all of these articles are made by attaching suitable surface treating segments such as flaps, discs or bristles, for example, to the outer peripheral surface of a rotatable core.

In the aforementioned articles, attachment of surface treating segments to a core may be accomplished by mechanical means and/or with a suitable adhesive. Although known mechanical attachments are relatively simple in their construction, they add weight to the finished article which, in turn, can cause rotational balancing problems in use. Additionally, the inclusion of mechanical attachments in the manufacture of surface treating articles can complicate manufacturing processes. Because of these difficulties, adhesives have been extensively employed as alternatives to mechanical fasteners in the manufacture of the foregoing articles.

Although the use of adhesives has been successful in overcoming many of the problems associated with mechanical attachments, other problems have arisen. A significant problem has been the formation of void spaces in the adhesive. To provide a strong adhesive bond resistant to failure during normal brush operation under high rotational forces, the bond line between the core and each of the surface treating segments must be substantially continuous (e.g., with no significant voids in the adhesive to serve as stress risers). In practice, however, voids of significant volume frequently occur within the core/segment bond line which, in turn, can result in a weakened bond that may cause adhesive failure when the finished article is later used. Moreover, such voids in the cured adhesive are difficult to detect due to the overall size of many surface treating articles. For example, depending on the intended use of the finished article, abrasive articles such as flap brushes and the like are manufactured to have a significant width (e.g., 0.5 meter or more), making an adequate inspection of the adhesive bond line between the core and the individual segments difficult at best. Accordingly, it is desirable to provide surface treating articles such as flap brushes, cleaning brushes, bristle brushes, convolute wheels and the like wherein the surface treating segments are attached to the core with an adhesive and wherein the adhesive is effective in forming a strong core/segment interface substantially free of objectionable void spaces.

Aside from the above described concerns relating to mechanical failure, additional aesthetic concerns are raised by the formation of voids in the core/segment interface. In the manufacture of the flap brushes, for example, the manufactured brush is often cut to a smaller size for certain applications. Cutting the manufactured article exposes a new portion of the core/segment interface that may or may not have a uniform and concentric adhesive bond line. The presence of visible void spaces in the adhesive interface may be considered undesirable for aesthetic reasons. Accordingly, it is desirable to provide surface treating articles such as flap brushes, cleaning brushes, bristle brushes, convolute wheels and the like wherein an adhesive is used in the attachment of the surface treating segments to the core and wherein the adhesive provides a strong and aesthetically acceptable interface between the segments and the core.

Efforts have been made to solve the problem of adhesive failure by making mechanical modifications to the construction of the core, for example, to promote the uniform application of adhesive over the core. Although these efforts have met with some success, it is desirable to provide a solution to the aforementioned problem without the need to substantially modify the mechanical components of the aforementioned surface treating articles. It is desirable to provide surface treating articles such as flap brushes, cleaning brushes, bristle brushes, convolute wheels and the like wherein an adhesive is used in the attachment of the surface treating segments to the core and wherein the adhesive is expansive in a molten or fluid state so that, when the surface treating segments are applied to the core member, the adhesive will expand into and around the segments to form a strong bond between the core member and the abrasive segments and wherein the expanded adhesive is substantially free of significant void spaces.

SUMMARY OF THE INVENTION

The present invention provides surface treating articles such as flap brushes, cleaning brushes, convolute wheels and the like wherein the abrasive or surface treating segments of the article are affixed to a rotatable core with an expansive adhesive. The adhesive used in the articles of the present invention is applied to the core during the manufacturing process, and surface treating segments are then applied to the adhesive on the core. The adhesive is expanded (e.g., by heating) into and around a portion of each the surface treating segments and the adhesive is hardened (e.g., by curing at elevated temperatures) to provide a core/segment bond line which is strong and substantially free of significant voids.

In one aspect, the present invention provides a surface treating article comprising:

- a rotatable core having an outer surface;
- a plurality of surface treating segments, each said segment having first portions adjacent said outer surface of said core and second portions opposite said first portions, said second portions collectively arranged to form a working surface of the surface treating article; and
- a cured expanded adhesive composition bonding said first portions of said surface treating segments to said outer surface of said core.

The core provides a locus for the attachment of the surface treating segments and preferably is a tube, rod, beam, pipe, or the like which may have a central bore therethrough. The core may include protrusions extending from the outer surface or it may have indentations along the outer surface, or a combination of protrusions and indentations. Surface treating segments useful in the articles of the invention include those comprising woven, nonwoven or knitted fabrics, foamed compositions (open or closed cell), flexible molded compositions and the like. The segments are preferably coated with a suitable binder and may include abrasive particles. Individual surface treating segments may be provided, for example, in the form of rolls, sheets, strips, annuli, discs, bristles, filaments, yarns, paper or polymeric film or any other form suitable for the manufacture of a particular abrasive article.

In a particularly preferred embodiment within this aspect if the invention, the cured expanded adhesive composition comprises the reaction product of:

a) an organic epoxide compound having an epoxide functionality of at least 1, b) an epoxide hardener, c) a film-forming material, and d) a foaming agent.

Accordingly, the cured adhesive preferably comprises a foamed organic epoxide which has been expanded into and around the edge of the segments adjacent the core. The organic epoxide preferably has an epoxide functionality between 2 and 4, and the epoxide hardener is preferably a mixture of dicyandiamide and 2,4-di-(N', N'-dimethylureido)toluene.

As used herein, "surface treating article" means any of a variety of articles useful in the treatment of surfaces including without limitation flap brushes, cleaning brushes, bonded wheels, bristle brushes and the like. "Surface treating segment" broadly means materials which can be affixed to a rotatable core to form a surface conditioning article including those specific materials described herein. "Expansive adhesive composition" means an uncured adhesive formulation capable of volume expansion by heating or the like. "Cured, expanded adhesive" or "cured adhesive" refers to an expansive adhesive composition which has undergone volume expansion and hardening (e.g., by heat curing). "Epoxide hardener" means curing agents, catalysts, epoxy curatives, and other curatives useful for curing epoxy resins.

In another aspect, the invention comprises a method for the manufacture of a surface treating article comprising:

a) applying an expansive adhesive composition to the outer periphery of a rotatable core, said adhesive composition comprising:
   i) an organic epoxide compound having an epoxide functionality of at least 1,
   ii) an epoxide hardener,
   iii) a film-forming material, and
   iv) a foaming agent;

b) providing a plurality of surface treating segments having first portions thereon suitable for positioning adjacent said core, and second portions which can be collectively arranged to form a working surface of the surface treating article;

c) applying said plurality of surface treating segments to said core by positioning said first portions adjacent said core and in contact with said adhesive;

d) expanding said expanded adhesive about said first portions of said surface treating segments; and e) hardening said adhesive to form the surface treating article.

In this aspect of the invention, the core and surface treating segments are as described in the first aspect of the invention. The application of the expansive adhesive to the core may be accomplished by applying the adhesive as an uncured paste or a film which can be expanded after its application. The preferred adhesive is one which will experience low sag and low volatile loss during cure, has high shear strength (tube shear and flexural shear) after cure and will readily bond to both the core and the surface treating segments. The application of the surface treating segments is accomplished in a manner suitable for the particular type of segments being used, as further described herein. Preferably, the adhesive can be both expanded and cured by the application of heat.

Those skilled in the art will further understand and appreciate the details of the invention upon the further consideration of the remainder of the disclosure, including the detailed description of the preferred embodiment and the appended claims.

BRIEF DESCRIPTION OF THE DRAWINGS

In describing structural aspects of the preferred embodiment, reference is made to the Figures, wherein.

DETAILED DESCRIPTION OF THE PREFERRED EMBODIMENT

Figure 1:
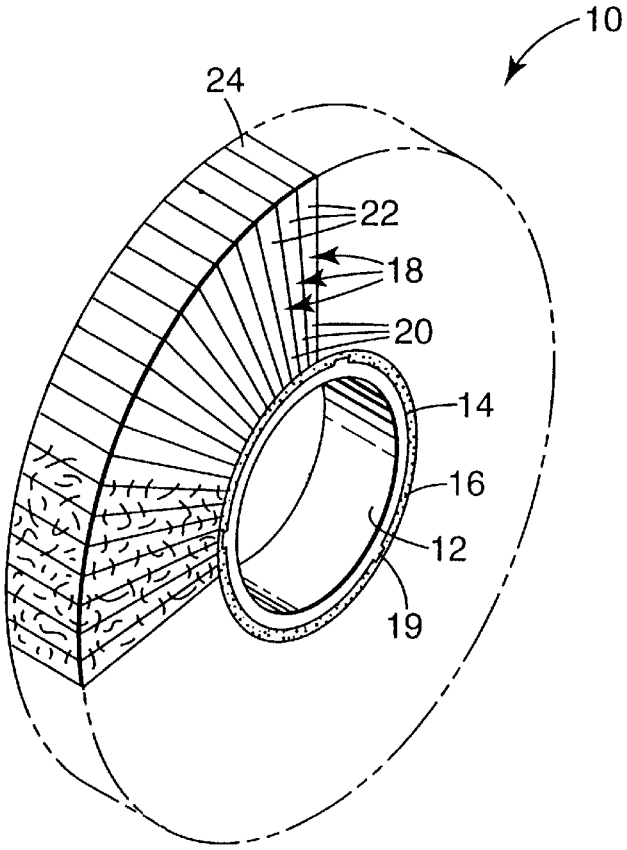
FIG. 1 is a perspective view of a flap brush according to a preferred embodiment of the invention.

The details of the preferred embodiment of the present invention will now be described with reference, in part, to the various figures wherein structural features of the described embodiment are identified with reference numerals and wherein like reference numerals indicate like structure.

Figure 2:
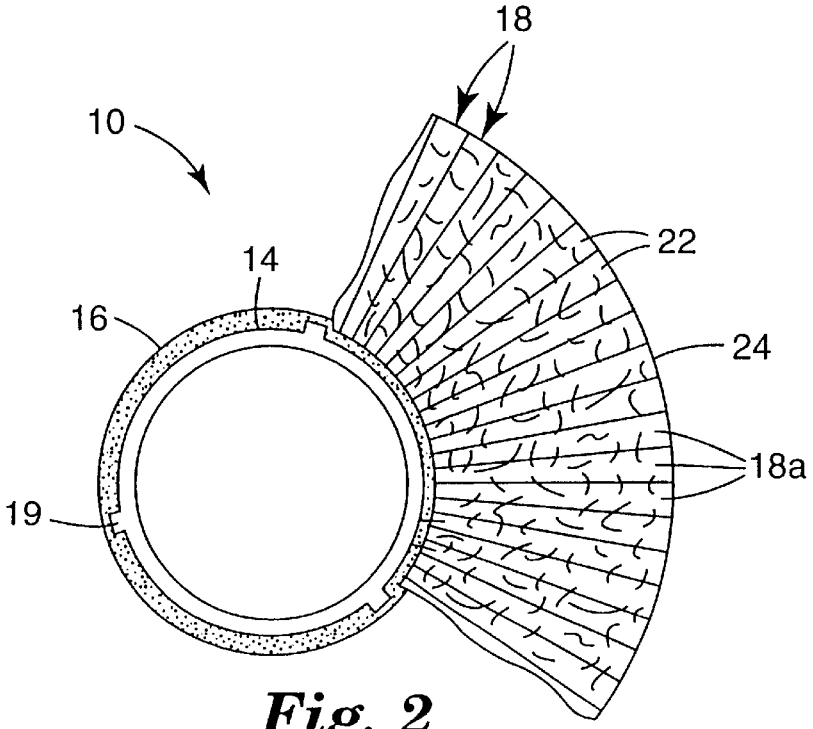
FIG. 2 is a side plane view of the flap brush depicted in FIG. 1 with flaps omitted to show detail.

Referring to the drawings, FIGS. 1 and 2 illustrate a flap brush 10 according to the present invention. It should be understood that the invention is not limited to the depicted flap brush 10. Rather, the present invention broadly relates to any of a wide variety of surface treating articles having the various features broadly described herein. The flap brush 10 has a cylindrical central core 12, a layer of adhesive 16 coated on the outer peripheral surface 14 of the core 12, and a plurality of radially extending surface treating segments in the form of abrasive flaps 18, 18*a*. Each of the flaps 18 include a first flap portion 20 (first portion), and a second flap portion 22 (second portion). The first portion 20 is adhered to the outer peripheral surface 14 of core 12 by the adhesive layer 16. Abrasive flaps 18 are packed tightly together to minimize relative movement between the adjacent flaps. For example, in a flap brush having an outer diameter of 15.2 cm (6 inches) and including one hundred twenty eight nonwoven abrasive flaps, the flaps 18 can be compressed at their first portions 20 to approximately 10% of their uncompressed thickness and at their second portions 22 to about 30% of their uncompressed thickness. In this arrangement, the individual second portions 22 of the flaps 18 cooperate to form a working brush surface 24 which may be applied against a workpiece (e.g., a printed circuit board) when the brush is rotated about its axis of rotation aligned about the center of the core 12. Those skilled in the art will understand that flap brushes may be made in other sizes and the invention is not to be construed as limited to the particular size or configuration depicted herein.

The outer surface of the core 12 provides a locus for the attachment of the abrasive flaps 18. Typically the core 12 is a tube, rod, beam, pipe, or the like with or without a central bore therethrough. The core 12 may be of any cross-sectional shape and of any length and diameter, but is preferably circular in cross-section, at least 1.59 mm (1/16 inch) long, and at least 1.59 mm (1/16 inch ) in outside diameter. Typically, core 12 is a central support member of tubular cross section 1 to 2 meters long and with an outer diameter of about 5 to about 61 cm. The actual dimension of the outer diameter 14 is typically dependent on the contemplated end use of the brush 10. The brush 10 may be cut along its length to provide a shorter length, as dictated by the contemplated application for which the brush is to be used.

Figure 4:
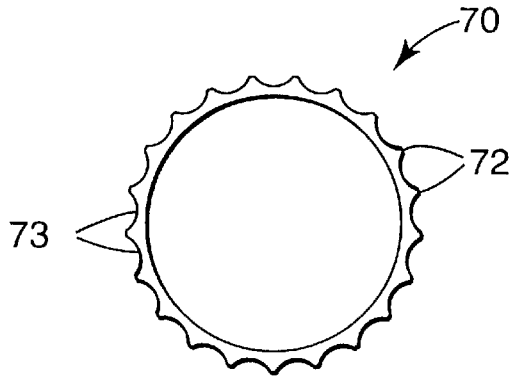
FIG. 4 is a side view of an embodiment of a core.

The core 12 may comprise any of a variety of suitable materials having sufficient structural strength to withstand processing in the manufacture of the article of the invention and to retain its structure in use. Useful core materials include, but are not limited to, composites including reinforcement provided by fabric particles, paper, fibers, nonwoven mesh materials, scrims or a combination thereof impregnated with, coated with or laminated to a cured organic binder such as thermosetting resin (e.g., phenolic resin) or thermoplastic resin, metal, wood, ceramic, unreinforced cured resinous material, or the like. Preferably, the core is made from a material to which adhesive 16 is sufficiently adherent with or without one or more intermediate surface preparation steps such as scuffing, priming, etc. It is also contemplated that the core 12, 10 may optionally include one or more protrusions 19, 72 (FIG. 4) or indentations 73 (FIG. 4) uniformly spaced about its circumference, as disclosed in U.S. Pat. No. 5,554,068 (Zimmerman et al.). The core 12 may serve to drive the brush 10 about its axis of rotation, and other known design features such as keys or keyways, splines, or reinforcing members (not shown) may also be incorporated as part of the core 12 of the brush 10.

Surface treating segments such as flaps 18 may be lofty nonwoven three-dimensional abrasive materials comprising crimped staple fibers, abrasive particles and a curable binder adhering the abrasive particles to the fibers of the nonwoven material. Although the brush 10 includes a plurality of the aforementioned flaps 18, it is intended that surface treating articles comprising other surface treating segments will be useful in the abrasive articles of the present invention limited only by the requirement that the surface treating segments may be successfully and usefully deployed about and adherently bonded to the core 12 by a curable expansive adhesive composition, as described herein.

Exemplary surface treating segments useful in the articles of the invention include without limitation coated abrasive compositions on woven, knitted, or nonwoven fabrics, paper or foam, lofty three-dimensional nonwoven abrasive compositions such as those disclosed in U.S. Pat. No. 2,958,593 (incorporated by reference herein), polymeric foam compositions of open or closed cell structure with optional abrasive material dispersed throughout, and abrasive filament compositions such as those described in U.S. Pat. No. 5,427,595 to Pihl et al. (incorporated by reference herein), and copending U.S. Pat. No. 5,460,883 of Barber et al. (incorporated by reference herein), especially where the filament compositions are attached to and protruding from a backing sheet or strip prior to the fabrication of the articles of the present invention. Surface treating segments may also comprise flexible molded abrasive compositions such as those described in U.S. Pat. No. 4,933,373 to Moren (incorporated by reference herein), wherein the flexible molded abrasive compositions comprise abrasive particles dispersed throughout and adhered within a tough, smear resistant, elastomeric crosslinked polyurethane binder matrix.

Lofty, three-dimensional nonwoven materials, preferably including abrasive particles adhered thereto, are particularly useful and are preferred in the articles of the present invention. Flaps 18, for example, made of such nonwoven material may be used in the construction of flap brushes such as the flap brush 10. Likewise, nonwoven resin bonded discs are useful in the manufacture of cleaning brushes used in cleaning operations for printed circuit boards and the like. Bonded surface conditioning wheels can also be manufactured within the teachings of the present invention. Surface treating segments useful in the present invention may be provided in rolls, sheets, strips, annuli, discs, or any other converted form as required to make a particular abrasive article.

Although the inclusion of abrasive particles in the surface treating segment is preferred, the inclusion of abrasive particles is optional. When included, the particles may be of any suitable hardness, size, or composition as may be appropriate for the contemplated application of the finished article, and such particles may be selected for inclusion in the articles according to known selection criteria. In surface polishing or light abrasive applications the surface treating segments may be free of abrasive particles.

The adhesive layer 16 is a cured, expanded adhesive resulting from the expansion and curing of an expansive adhesive composition. The expansive adhesive composition is capable of significant expansion upon curing, and the preferred ratio of the thickness of the cured adhesive to that of the uncured adhesive is within the range from about 1.1:1 to 10:1, more preferably from about 1.5:1 to 5:1 and most preferably 2:1 to 3:1. The expansive adhesive composition is adherent to both the core 12 and the surface treating segments 18 when cured. Useful adhesive compositions include, without limitation, polyacrylic, polyurethane, epoxy, and block copolymers of styrene and butadiene. Compatible mixtures may also be employed. Particularly useful are compositions comprising epoxy chemistry.

The preferred expansive adhesive composition is an essentially halogen-free, one-part epoxy composition comprising:

(a) an organic epoxide compound having an epoxide functionality of at least 1;

(b) an epoxide hardener;

(c) a film-forming material; and (d) a foaming agent.

More preferably, the expansive adhesive composition comprises:

(a) 100 parts by weight of an organic epoxide compound having an epoxide functionality of at least 1;

(b) from 2 to 180 parts by weight of an epoxide hardener;

(c) from 0.5 to 40 parts by weight of a film-forming material; and (d) from 0.5 to 30 parts by weight of a foaming agent.

The expansive adhesive composition is preferably of a form that may be readily applied to either the core 12 or to the surface treating segments, or to both, in a uniform manner. Acceptable physical forms for the adhesive prior to its application include bulk viscous fluid which could be uniformly applied by the use of the coating apparatus described below. More preferably, the uncured expansive adhesive is provided as a sheet or unsupported film, and most preferably, the unsupported film has a thickness ranging from about 5 to about 500 mil (about 0.12 to 13 mm). Such sheets or unsupported films may be made in a known manner such as by calendering the bulk viscous fluid composition to the appropriate thickness, for example.

Any organic compound having an oxirane ring polymerizable by a ring opening reaction may be used as the organic epoxide in the expansive adhesive compositions of the invention. Such materials, broadly called epoxides, include monomeric epoxy compounds and polymeric epoxy compounds and can be aliphatic, cycloaliphatic, aromatic or heterocyclic. Useful materials generally have at least one and preferably at least two polymerizable epoxy groups per molecule and, more preferably, from two to four polymerizable epoxy groups per molecule.

The organic epoxide may vary from low molecular weight monomeric products to high molecular weight polymers and may also vary greatly in the nature of the backbone and any substituent groups. The weight average molecular weight may vary from about 58 to about 100,000 or more. The backbone may be of any type. Substituents may be any group not having a nucleophilic or an electrophilic moiety (e.g., an active hydrogen atom) that is reactive with an oxirane ring. Permissible substituents include ester groups, ether groups, sulfonate groups, siloxane groups, nitro groups, amide groups, nitrile groups, phosphate groups and the like. Mixtures of various organic epoxides may also be used in the expansive adhesive compositions of the invention.

Preferred organic epoxides are selected from the group consisting of alkylene oxides, alkenyl oxides, glycidyl esters, glycidyl ethers, epoxy novolacs, copolymers of acrylic acid esters of glycidol and copolymerizable vinyl compounds, polyurethane polyepoxides, and mixtures thereof. More preferably, the organic epoxide is selected from the group consisting diglycidyl ethers of bisphenol A and epoxy novolacs. Other useful organic epoxides include those disclosed in U.S. Pat. No. 5,019,605, U.S. Pat. No. 4,145,369, U.S. Pat. No. 3,445,436, U.S. Pat. No. 3,018,262, and *Handbook of Epoxy Resins* by Lee and Neville, McGraw Hill Book Co., New York (1967), the disclosures of which with respect to organic epoxides are incorporated herein by reference.

Epoxide hardeners useful in these compositions are materials that react with the oxirane ring of the organic epoxide to cause substantial crosslinking of the epoxide. These materials contain at least one nucleophilic or electrophilic moiety (e.g., an active hydrogen atom) that cause the crosslinking reaction to occur. Epoxide hardeners are distinct from epoxide chain extension agents, which primarily become lodged between chains of the organic epoxide and cause little, if any, crosslinking. Epoxide hardeners as used herein are also known in the art as curing agents, catalysts, epoxy curatives, and curatives.

Epoxide hardeners useful in the expansive adhesive compositions of the invention include those which are conventionally used for curing epoxy resin compositions and forming crosslinked polymer networks. Such agents include aliphatic and aromatic primary amines, for example, di-(4-aminophenyl)sulfone, di-(4-aminophenyl)-ethers, and 2,2-bis(4-aminophenyl)propane. Such compounds also include aliphatic and aromatic tertiary amines such as dimethylaminopropylamine and pyridine, which may act as catalysts to generate substantial crosslinking. Further, boron complexes, in particular boron complexes with monoethanolamine, imidazoles such as 2-ethyl-methylimidazole, guanidines such as tetramethyl guanidine, substituted ureas such as toluene diisocyanate urea, dicyanodiamide, and acid anhydrides such as the 4-methyltetrahydroxyphthalic acid anhydride, 3-methyltetrahydroxyphthalic acid anhydride and methylnorbornenephthalic acid anhydride, may be employed. Still other useful hardeners include polyamines, mercaptans and phenols.

Preferably, the epoxide hardener is selected from the group consisting of amines, acid anhydrides, guanidines, dicyandiamide and mixtures thereof. More preferably the epoxide hardener is a mixture of dicyandiamide of formula I:

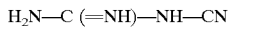

$$H_2N—C(=NH)—NH—CN \quad \text{I}$$

and 2,4-di-(N'N'-dimethylureido)toluene of formula II:

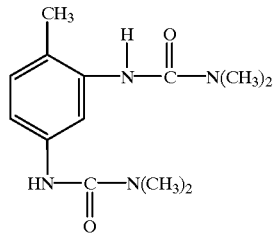

II

The amount of epoxide hardener that is required will vary depending on the particular hardener and epoxide. However, the hardener should be provided in an amount sufficient to cause substantially complete hardening of the composition within a desired length of time. About 2 to 180 parts by weight, based on 100 parts by weight of the organic epoxide, of an epoxide hardener is preferred. More preferred is the use of about 6 to 20 parts by weight of the epoxide hardener.

The expansive adhesive compositions of the invention further comprise a film-forming material. Preferred film-forming materials are selected from the group consisting of butadiene/nitrile rubbers, carboxylated butadiene/nitrile rubbers ("CBN rubbers"), amine-terminated butadiene/nitrile rubbers, polyether diamines, polyhydroxyethers, graft polymers having a rubbery polyacrylate core with a polyacrylate or polymethacrylate shell, polyvinyl acetals and mixtures thereof. More preferably, the film-forming material is a mixture of: (i) a polyhydroxyether compound such as a phenoxy resin, and (ii) a rubber component such as a CBN rubber. The amount of the film-forming material present in the expansive adhesive compositions of the invention will vary from about 0.5 to 40 parts by weight and, more preferably, from about 20 to 30 parts by weight, based on 100 parts by weight of the organic epoxide.

Expansive adhesive compositions according to the invention also include about 0.5 to 30 parts by weight, based on 100 parts by weight of the organic epoxide, of a foaming agent. Preferably the foaming agent is selected from the group consisting of: (i) materials that liberate a gas or a vapor upon heating, (ii) liquefied gases encapsulated in a polymeric thermoplastic shell, and (iii) mixtures thereof. More preferably, the composition comprises about 2 to 8 parts by weight of a foaming agent selected from the group consisting of: (i) azobisisobutryonitriles, azodicarbonamides, carbazides, hydrazides, non-azo chemical blowing agents based on sodium borohydride or sodium bicarbonate/citric acid, dinitrosopentamethylenetetraamine, (ii) liquefied gases encapsulated in a polymeric thermoplastic shell, and (iii) mixtures thereof. Most preferably, the foaming agent is 4 to 6 parts by weight of liquid isobutane encapsulated in microspheres consisting of a thermoplastic shell such as that commercially available under the trade designation EXPANCEL available from Nobel Industries.

Other optional ingredients that may be preferably incorporated into the expansive adhesive compositions of the invention include wetting agents (preferably up to about 15 parts per 100 parts by weight of the organic epoxide) and low density fillers which are materials capable of reducing the density of the composition (preferably up to about 100 parts per 100 parts by weight of the organic epoxide). Useful wetting agents may be selected from the group consisting of titanates, silanes, zirconates, zircoaluminates and mixtures thereof. The wetting agent improves the mixability and processability of the composition and can also enhance the composition's handling characteristics. Useful wetting agents are disclosed in U.S. Pat. No. 5,019,605. Low density fillers that may be used include hollow microspheres such as hollow glass microspheres.

Preferably, the expansive adhesive compositions of the invention are first compounded into the form of an uncured paste that is subsequently converted, when needed, into a film form by melt extrusion, lamination or calendering. A particularly preferred epoxy composition useful as the expansive adhesive composition of the invention comprises:

(a) 100 parts by weight of an organic epoxide compound having an epoxide functionality of from 2 to 4;

(b) about 6 to 20 parts by weight of an epoxide hardener;

(c) about 20 to 30 parts by weight of a film-forming forming material;

(d) about 4 to 6 parts by weight of a foaming agent;

(e) optionally, up to 15 parts by weight of a wetting agent; and (f) optionally, up to 100 parts by weight of an inorganic filler capable of reducing the density of the composition.

This composition, when provided as a paste or an uncured film, can be expanded by polymerization. Preferably, the foaming agent provides an expansion rate of up to 300%, the expansion rate being the ratio of the volume of the cured product to the volume of the initial uncured product.

The preferred adhesive composition of the present invention will have substantial initial adhesion, or "tack", at normal room temperature (e.g., 20° C.). This tack can present a handling problem, especially when the composition is in sheet form, since the composition may aggressively bond to itself if incidental contact is made. Generally, this problem may be obviated by storing the composition at diminished temperature, e.g., 40° F. or lower (about 5° C. or lower).

Figure 3:
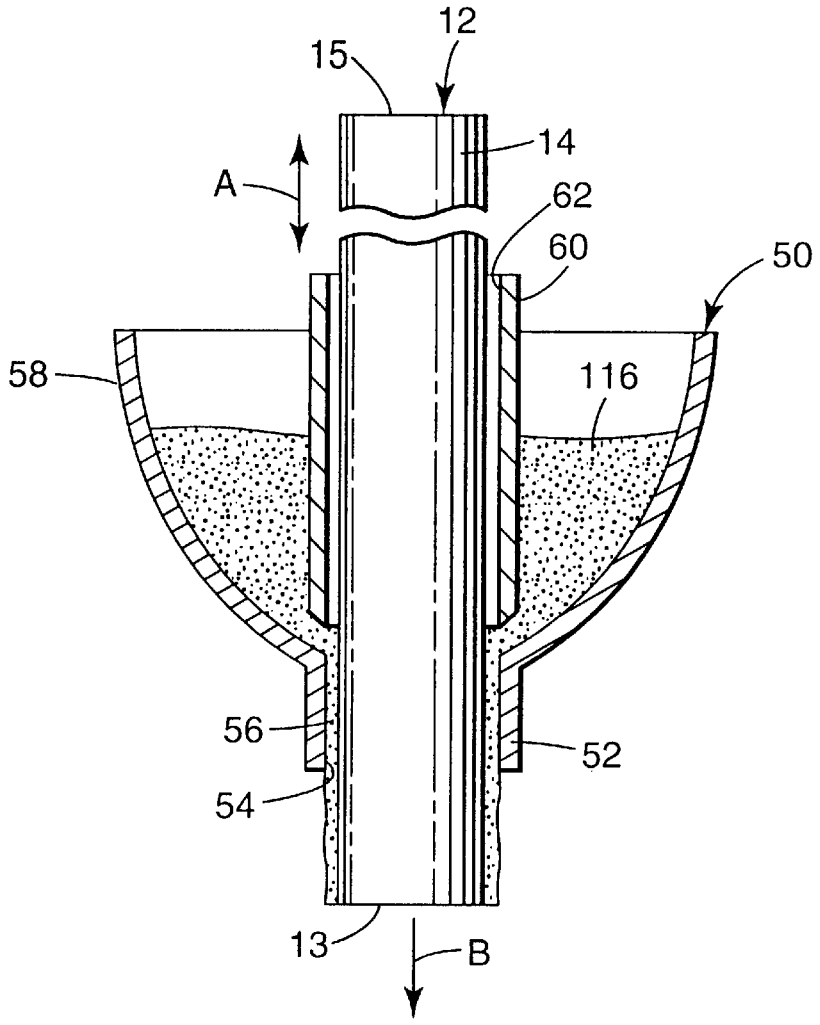
FIG. 3 is a partial cross-sectional view of a core and an adhesive coating apparatus, illustrating a preferred method for surface coating a core of a surface treating article with adhesive.

Useful abrasive articles of the present invention may be made by any of a number of processes. Several such processes, which employ surface treating segments such as flaps 18 comprising lofty, 3-dimensional nonwoven abrasive-containing materials include an initial step of applying the expansive adhesive composition to the periphery of the core 12. FIG. 3 illustrates one preferred method where the expansive adhesive composition 116 is a viscous fluid or paste coated over or applied to the core 12 using an adhesive coater 50. The coater 50 includes a central bore 52 having an inner diameter at wall 54 larger than the outer diameter of the core 12, resulting in a gap 56 between the outer surface 14 of the core 12 and the wall 54. A sufficient amount of the adhesive 116 to coat the core 12 is held within the funnel portion 58 of coater 50. Valve 60 is provided initially in the closed position resting against the inner wall of the funnel 58 nearest the bore 52. Valve 60 can be opened by vertically moving it away from the funnel portion 58, as indicated by the arrow A. When valve 60 is opened, adhesive 116 flows into space 56 and around the periphery 14 of the core 12. The valve 60 is preferably maintained in the opened position and the first end 13 of the core 12 is moved in the direction indicated by the arrow B through the bore 52 to thereby apply adhesive 116 to the outer surface 14 along the full length of the core 12 to the second end 15 in a uniform manner. In this process, the core 12 and the bore 52 are maintained in a concentric relationship with respect to one another to provide a uniform coating of the adhesive 116 on the periphery 14 of the core 12. Preferably, a frame member (not shown) is provided to hold the valve 60 and inner surface of the valve 62 in a concentric relationship relative to the core. The foregoing procedure may be accomplished using a known apparatus. In this manner, the adhesive 116, provided as a the viscous fluid or paste, is uniformly spread over the core 12.

Alternatively, if the expansive adhesive composition is supplied in the form of a sheet or unsupported film, the sheet may be cut to the appropriate dimensions and applied to the periphery of the core in a known manner.

Having applied the expansive adhesive composition to the core 12, surface treating segments such as flaps 18 may be applied to the adhesive in a known manner. In the application of the flaps 18 or other surface treating segments comprising lofty, 3-dimensional nonwoven abrasive-containing material, the segments may be applied according to the following known and non-limiting options:

1) By urging rectangular-shaped segments (e.g., flaps 18) edge-wise into the expansive adhesive composition layer so that the segments protrude radially from the periphery of the core;

2) by stacking surface treating segments in the form of annularly-shaped discs, each having an outer diameter and an aperture extending therethrough dimensioned to receive the core therein. The inner diameter of the aperture is positioned adjacent the core and into the expansive adhesive composition such that the inner diameter of the annularly-shaped discs is in close proximity to the periphery of said core, orienting the annularly-shaped disc such that the outer diameter thereof is either perpendicular to or at some other desired angle to the rotational axis of the core; or 3) by applying one leading edge of a roll of nonwoven material of appropriate length and width to the periphery of the core and in contact with the expansive adhesive composition and subsequently wrapping the said nonwoven material around the core in progressive, helical layers (i.e., convoluted, or in "jelly roll" fashion) until an article of the appropriate outer diameter is achieved.

The above methods of applying nonwoven surface treating segments to the adhesive-coated core are known. The application of other types of surface treating segments is contemplated and is believed to be within the skill of those in the art without the need for undue experimentation.

Following the application of the surface treating segments to the periphery of the core, the resulting assembly is heated, typically in a convection oven, to cause the expansive adhesive composition to expand to, into, and/or through at least a portion of the segments, and to securely adhere thereto. Preferred temperatures for heating the expansive adhesive composition will be within the range from about 250° F. to about 350° F. Further application of heat for a period of about 20 minutes after adhesive has reached its maximum expansion effects the cure of the adhesive composition. The expansive adhesive composition may exhibit viscous flow at a temperature below that normally required for the onset of curing. To keep the uncured adhesive from migrating, wicking or otherwise migrating from the interfaces to be bonded, it is important to minimize the time at which the composition is above the temperature at which such flow is initiated and below the temperature at which curing is initiated. Those skilled in the art will appreciate that the exact temperatures at which flow and cure are initiated will vary with the chemical composition of the uncured adhesive being used. Pre-heating of the oven or other suitable heat source to the appropriate cure temperature will help to minimize the time available for undesired flow.

Following heating, the assembly is allowed to cool at ambient conditions (e.g., existing room temperature and humidity), cut to the appropriate length, if necessary, and further converted for final end use as needed, e.g., for use with particular machinery, all in a known manner.

Further benefits and advantages of the present invention are demonstrated by the following non-limiting examples.

Test Procedure

In the testing of the articles made according to the Examples, the following test procedure was employed.

Rotational Failure Test

To determine the maximum rotational operating speed of wheels, brushes and discs, a test article is rotated and the rate of rotation is controllably increased until the article fails. The test is performed on a steam driven Rotational Failure Speed machine capable of rotating the test articles up to 29,000 rotations per minute (rpm) (available from Barbour Stockwell Co. of Cambridge, Mass.). Appropriate hardware is employed depending on the inner diameter of the core and the outer diameter of the article being tested. The testing is accomplished by mounting the article between flanges (2.54 cm inner diameter and 3.81 cm outer diameter). The machine is started and adjusted to achieve a rotational speed of 1,000 rpm. The article is accelerated at a rate of 1,000 (±200) rpm per 30 second intervals until failure occurs. The rotational speed at failure is noted and recorded for each article tested.

EXAMPLES

Example 1

Flap Brush Construction

This inventive Example demonstrates the efficacy of the present invention when employed to make a flap brush construction. A single layer of 100 mil (2.5 mm) thick expandable adhesive sheet (trade designation "SCOTCH-WELD Structural Core Splice Adhesive AF-3024", available from Minnesota Mining and Manufacturing Company, St. Paul, Minn.) that had been stored at about 5° C. (40° F.) for a minimum of one hour was applied to the periphery of a 20.3 cm (8-inch) long section of a glass-reinforced composite core of outer diameter. 3.6 cm (1 7/16 inches) and inner diameter. 2.5 cm (1 inch) (available from Aligned Fiber Composites, Chatfield, Minn.). Seventy-two (72) rectangular strips of a lofty, 3-dimensional nonwoven abrasive material (trade designation "SCOTCH-BRITE Type A-Medium Clean and Finish" available from the Minnesota Mining and Manufacturing Company) of 5.1 mm (0.20 inch) thickness, 3.5 cm (1 3/8 inches) width, and slightly less than 20.3 cm (8 inches) length were simultaneously radially pressed into the adhesive sheet surrounding the core such that the edges along each approximate 20.3 cm dimension were contacting the adhesive sheet. Heat was then applied by directing the output of a heat gun through the inner diameter of the core for 35 minutes, immediately followed by further curing in a forced air convection oven set at 350° F. for 45 minutes more. The resulting flap brush was cut into four ca. 2 inch (5.08 cm)-wide flap brushes.

Each of the foregoing brushes was visually inspected for bond-line integrity with no visible voids observed at the adhesive interfaces. Visual inspection indicated that the expandable adhesive had filled voids originally created by an initial inappropriate positioning of a flap which had not been pushed far enough toward the core. All of the brushes were tested according to the above Rotational Failure Test. The test machine was fitted with a 2.54 cm (one inch) mounting spindle and each of the brushes was mounted on the spindle between the flanges. None of the brushes failed due to adhesive failure. In all cases, the brushes failed due to tearing of the nonwoven abrasive material at about midline thereof and radially throughout each of the brushes.

The foregoing results of the Rotational Failure Test demonstrate the surprising and unexpected benefits of an expandable adhesive composition in the construction of a suitable surface treating article to thereby avoid the formation of void spaces in the adhesive or between the adhesive and the surface treating segments.

EXAMPLE 2

Cleaning Brush

This inventive Example demonstrates the advantages of the present invention when employed to make a stacked-disc brush construction. Four 6.35 mm×6.35 mm×40.6 cm long (¼ in.×¼ in.×16 in. long) aluminum keys were adhesively attached 90° apart about the periphery of a scuffed 12.86 cm inner diameter.×13.67 cm outer diameter.×40.6 cm long (5 1/16 in. inner diameter.×5.38 in. outer diameter.×16 in. long) glass-reinforced composite core (available from Aligned Fiber Composites, Chatfield, Minn.) such that their long axes were parallel to the rotational axis of the cylindrical core. A single layer of 100 mil (2.5 mm) thick expandable adhesive sheet ("SCOTCH-WELD Structural Core Splice Adhesive AF-3024") that had been stored at about 40° F. (5° C.) for about 20 minutes prior to use was applied as four 10.2×30.5 cm (4 in.×12 in.) strips to the periphery of the core between the keys. Approximately 80 annuli of dimension 30.5 cm outer diameter.×15.2 cm inner diameter.×5.1 mm thick (12 in. outer diameter.×6 in. inner diameter.×0.20 in. thick) of a lofty, 3-dimensional nonwoven abrasive material ("SCOTCH-BRITE Type A-Medium Clean and Finish") were cut and provided with four 6.35 mm×6.35 mm (¼ in.×¼ in.) keyways equally spaced (90° apart) about the inner diameter to match the keys provided on the outer diameter of the core. The annuli were manually loaded onto the adhesive/core composite with the annuli diameters perpendicular to the rotational axis of the core, compressed to about 75% of their original aggregate thickness by the use of end plates and a threaded rod, and cured by placing the compressed assembly in a forced convection oven for 90 minutes at 275° F. (135° C.).

After slowly cooling to room temperature at ambient conditions and releasing the press, the adhesive bond line of the brush was visually inspected. No visible voids were observed in the cured adhesive and the bond line was observed to be uniform and concentric about the rotational axis of the article.

Although the preferred embodiment of the invention has been described in some detail, those skilled in the art will appreciate that changes and modifications to the described embodiment can be made without departing from the true spirit and scope of the invention, as defined in the appended claims.

What is claimed is:

1. A surface treating article, comprising:

a rotatable core having an outer surface;

a plurality of surface treating segments, each of said segments having a first portion adjacent said outer surface of said core and second portions opposite said first portions, said second portions collectively arranged to form a working surface of the surface treating article; and a cured expanded adhesive composition bonding said first portions of said surface treating segments to said outer surface of said core, wherein, said cured expanded adhesive composition comprises the reaction product of:

a) an organic epoxide compound having an epoxide functionality of at least 1, b) an epoxide hardener, c) a film-forming material selected from the group consisting of butadiene/nitrile rubbers, carboxylated butadiene/nitrile rubbers, carboxy-terminated butadiene/nitrile rubbers, amine-terminated butadiene/nitrile rubbers, polyether diamines, polyhydroxyethers, graft polymers having a rubbery polyacrylate core with a polyacrylate or polymethacrylate shell, polyvinyl acetals and mixtures thereof, and d) a foaming agent selected from the group consisting of azobisisobutyronitriles, azodicarbonamides, carbazides, hydrazides, non-azo chemical blowing agents based on sodium borohydride or sodium bicarbonate/citric acid, dinitrosopentamethylenetetramines, liquefied gases encapsulated in a polymeric thermoplastic shell, and mixtures of the foregoing materials.

2. The article as defined in claim 1 wherein said core is a tubular member having a structure comprised of a material selected from the group consisting of porous sheet material rigidified with resin binder, thermosetting compositions, thermoplastic compositions, metal, wood, ceramic and combinations of the foregoing materials.

3. The article as defined in claim 1 wherein said core includes protrusions extending from said outer surface.

4. The article as defined in claim 1 wherein said core includes indentations along said outer surface.

5. The article as defined in claim 1 wherein each said surface treating segment comprises a substrate selected from the group consisting of woven fabric, nonwoven fabric, paper, polymeric materials, filaments and combinations of the foregoing.

6. The article as defined in claim 5 wherein said polymeric material comprises a foamed composition having abrasive particles dispersed therethrough.

7. The article as defined in claim 5 wherein said nonwoven fabric is a lofty, three-dimensional network of fibers.

8. The article as defined in claim 7 wherein said nonwoven fabric further comprises abrasive particles adhered to said fibers.

9. The article as defined in claim 1 wherein said surface treating segments comprise abrasive particles dispersed throughout and adhered within a tough, smear resistant, elastomeric, crosslinked polyurethane binder matrix.

10. The article as defined in claims 1 wherein said organic epoxide is selected from the group consisting of alkylene oxides, alkenyl oxides, glycidyl esters, glycidyl ethers, epoxy novolacs, copolymers of acrylic acid esters of gycidol and copolymerizable vinyl compounds, polyurethane polyepoxides and mixtures thereof.

11. The article as defined in claim 10 wherein said organic epoxide has an epoxide functionality of from 2 to 4.

12. The article as defined in claim 10 wherein said epoxide hardener is selected from the group consisting of amines, acid anhydrides, boron complexes, guanidines, dicyandiamide and mixtures thereof.

13. The article as defined in claim 10 wherein said epoxide hardener is a mixture of dicyandiamide and 2,4-di-(N',N'-dimethylureido)toluene.

14. The article as defined in claim 1 wherein said film-forming material is a mixture of a phenoxy resin and of a carboxy terminated butadiene/nitrile.

15. The article as defined in claim 1 wherein the foaming agent is a liquid isobutane encapsulated in microspheres having a thermoplastic shell and providing about 4 to 6 parts by weight of the expanded adhesive composition.

16. The article as defined in claim 1 wherein prior to curing a) said organic epoxide is present at a concentration of about 100 parts by weight, said epoxide having an epoxide functionality of from 2 to 4;

b) said epoxy hardener is present at a concentration within the range from about 2 to 20 parts by weight;

c) said film forming material is present at a concentration within the range from about 20 to 30 parts by weight; and d) said foaming agent is present at a concentration within the range from about 4 to 6 parts by weight.

* * * * *